United States Patent [19]

Zaharis

[11] 4,344,405

[45] Aug. 17, 1982

[54] INTERNAL COMBUSTION ENGINE

[76] Inventor: Edward J. Zaharis, 18728 Bollinger Canyon Rd., San Ramon, Calif. 94583

[21] Appl. No.: 218,350

[22] Filed: Dec. 22, 1980

[51] Int. Cl.[3] ..... F02M 25/06

[52] U.S. Cl. ..... 123/568; 123/68; 123/432

[58] Field of Search ..... 123/568, 571, 68, 432, 123/433

[56] References Cited

U.S. PATENT DOCUMENTS

| | | | |
|---|---|---|---|
| 1,830,197 | 11/1931 | Felbeck | 123/568 |
| 1,952,881 | 3/1939 | Minter | 123/568 |
| 2,769,435 | 11/1956 | Cass | 123/68 |
| 3,148,668 | 9/1964 | Bianchi | 123/68 |
| 3,583,375 | 6/1971 | Pischinger | 123/568 X |
| 3,703,164 | 11/1972 | Weaving | 123/568 |
| 4,282,845 | 8/1981 | Nohira | 123/433 X |

FOREIGN PATENT DOCUMENTS

| | | | |
|---|---|---|---|
| 54-148926 | 11/1979 | Japan | 123/568 |

*Primary Examiner*—Wendell E. Burns

*Attorney, Agent, or Firm*—Manfred M. Warren; Robert B. Chickering; Glen R. Grunewald

[57] ABSTRACT

An internal combustion engine having both an air-fuel mixture and exhaust in the cylinder during the compression stroke with one of the air-fuel mixture and exhaust being in the cylinder at the start of the compression stroke and the other being pumped into the cylinder during the compression stroke, with the shape of the cylinder head being adapted to maintain the air-fuel mixture undiluted with exhaust.

7 Claims, 2 Drawing Figures

INTERNAL COMBUSTION ENGINE

BACKGROUND OF THE INVENTION

This invention relates to internal combustion engines of the type in which a piston reciprocates in a cylinder. Piston internal combustion engines are generally of types known as two-stroke engines and four-stroke engines. A four-stroke engine has four separate strokes of the piston within the cylinder for each cycle. These are known as the intake stroke in which a mixture of air and fuel is drawn into the cylinder, the compression stroke in which this combustible mixture is compressed, the power stroke which is the stroke in which the piston is forced away from the head of the cylinder by the energy of the burning air-fuel mixture, and the exhaust stroke in which the piston moves toward the cylinder head and pushes the burned combustion products from the cylinder through an exhaust valve. A two-stroke engine has only two strokes per cycle. In a two-stroke engine the exhaust function and the intake function occur simultaneously at the end of the power stroke, as will be discussed.

The power output of an internal combustion engine is normally controlled by throttling the air-fuel supply. When an internal combustion engine is running at constant speed with the throttle approximately fully opened, it will function smoothly and efficiently. However, when the speed is varied and particularly when the air-fuel mixture is throttled to a great extent, an internal combustion engine will run poorly and inefficiently.

In a two-stroke engine the exhaust function is usually accomplished by providing ports in the cylinder wall that are uncovered when the piston is at the end of the power stroke. When the exhaust ports are uncovered high pressure exhaust gas escapes through an exhaust manifold, however, the cylinder is full of residual exhaust gas at approximately atmospheric pressure when the compression stroke begins. While the exhaust is being vented, the combustible mixture of air and fuel is pumped into the cylinder, usually by crankcase pressure that is generated by the underside of the piston during the power stroke. Venting exhaust and introducing air-fuel mixture simultaneously is done to a greater or lesser degree of efficiency by directing the flow of air-fuel mixture to flush out exhaust. Since air-fuel mixture is forced into the cylinder by the pressure in the crankcase, it must enter the cylinder at the end of the power stroke because crankcase pressure diminishes during the compression stroke because of movement of the piston toward the cylinder head and away from the crankcase. When the compression stroke is complete the cylinder contains both the air-fuel mixture and residual exhaust gas.

When a two-stroke engine is running with the throttle open it functions adequately because the proportion of air-fuel mixture to exhaust gas in the cylinder is high. However, when running under throttled conditions, the proportion of exhaust gas is so high that its dilution effect on the air-fuel mixture prevents combustion. As a result, the cylinder doesn't fire until one or more further cycles are completed because each cycle without firing increases the proportion of air-fuel mixture to exhaust, so eventually there is enough combustible gas in the cylinder to fire. This phenomenon produces the characteristic sound of two-stroke engines at idling speeds or at low speeds. However, even when a two-stroke engine is running with the throttle open enough to provide smooth firing, combustion is suppressed by the presence of exhaust gas to a greater or lesser extent and the full value of the fuel is not obtained with a resultant loss of efficiency.

Four-stroke internal combustion engines also are made to run most effectively with an open throttle. The efficiency of a four-stroke engine is related to the pressure in the cylinder at the end of the compression stroke. When functioning at low operating speeds with the throttle restricted to limit the amount of air-fuel mixture taken into the cylinder, at the end of the intake stroke the internal pressure of the cylinder is much lower than it would be if the engine were running with the throttle open. As a result, the pressure in the cylinder at the end of the compression stroke is too low for efficient operation.

It has been suggested in the past to deal with this problem by introducing exhaust gas into the cylinder of a four-stroke internal combustion engine. This has been accomplished by having the piston uncover ports in the cylinder that are open to exhaust when the piston is at the end of the intake stroke, for example, as illustrated in U.S. Pat. No. 3,583,375, or by keeping the exhaust valve open through some portion of the intake stroke to draw exhaust already expelled from the cylinder back into it. In all such arrangements, the dilution of the incoming air-fuel mixture with exhaust gas influences the combustibility of the air-fuel mixture. In extreme cases, dilution of the air-fuel mixture with exhaust will cause the gas mixture in the cylinder to be incombustible and in less extreme cases, the presence of combustion products in the cylinder suppresses the ability of the air-fuel mixture to burn effectively.

SUMMARY OF THE INVENTION

This invention solves or greatly mitigates the problems set forth above. This invention is an internal combustion engine of the reciprocating piston type which provides to the cylinder appropriate quantities of combustible air-fuel mixture and exhaust gas, and which further provides these different gases to the cylinder at a time and in a position to avoid the problems set forth above.

In its broadest sense this invention relates to an internal combustion engine of the reciprocating piston type having an inlet for combustible mixture of air and fuel and an outlet for exhaust. The inlet is adapted to maintain the combustible mixture as a substantially undiluted body of gas even though it is sharing the space between the piston and the cylinder head with exhaust gas. The inlet is adapted by being in a shaped chamber that is readily flushed by air-fuel mixture or by being positioned far from an exhaust inlet and close to a spark plug. The air-fuel mixture is maintained undiluted both by the location of the air-fuel inlet and by having the interface between air-fuel mixture and exhaust created largely under superatmospheric pressure. If the inlet for air-fuel mixture is shaped as a narrow chamber to avoid mixing of the air-fuel mixture with exhaust gas, it must not be shaped to isolate the combustible mixture to the extent that it interferes with the compression ratio, with the burning characteristics of fuel or with the transfer of energy to the main cylinder chamber.

In this discussion, two separate gases are involved. One gas is the exhaust gas and another is the air-fuel mixture. In accordance with the invention, means are provided to fill the cylinder with one of these gases before the compression stroke of the piston begins. As will be explained in more detail hereinafter, in a two-stroke engine the cylinder is filled with exhaust gas before the compression stroke begins while in a four-stroke engine the cylinder is filled with air-fuel mixture before the compression stroke begins. The word filled in the sense of this discussion means that the entire volume of the cylinder is occupied by that gas rather than that the cylinder contains as much of that gas as it is possible to introduce into it. Thus, when a four-stroke engine is idling, very little air-fuel mixture will be introduced into the cylinder during the intake stroke, but at the end of the intake stroke nothing but air-fuel mixture will be in the cylinder.

The engine of this invention also includes a pump for supplying the other of the combustible mixture or the exhaust, to the interior of the cylinder during the compression stroke with at least half of it being introduced into the cylinder after the exhaust outlet has closed. The second gas supplied to the cylinder, whether it be exhaust or air-fuel mixture, must be pumped into the cylinder because it must enter the cylinder against the pressure that is created by the compression stroke.

By introducing the second gas into the cylinder via a pump and during the compression stroke, two desirable effects are obtained. The first effect is that by being forced into the cylinder against the pressure of an already-compressed gas, the diffusion rate of the molecules of the second gas is correspondingly diminished and mixing of the first gas and the second gas is diminished. The second desirable effect is that the second gas coexists in the cylinder with the first gas for a shorter time period which also diminishes the mixing of the two gases.

The overall effect of the internal combustion engine made in accordance with this invention is that the combustible gas is in the form of a discrete body that is undiluted with exhaust and therefore is capable of burning effectively, efficiently and completely, that the engine always operates with the appropriate pressure in the cylinder, and that the volume of the exhaust gas in the cylinder produces a cushioning or a compressible-piston effect that uses the energy of combustion effectively. The internal combustion engines of this invention will employ appropriate and known means for operating the valves, for cooling, for ignition, and for effecting the other functions necessary for operating an internal combustion engine.

DETAILED DESCRIPTION OF THE INVENTION

This invention will be descried with respect to the accompanying drawings.

Figure 1:
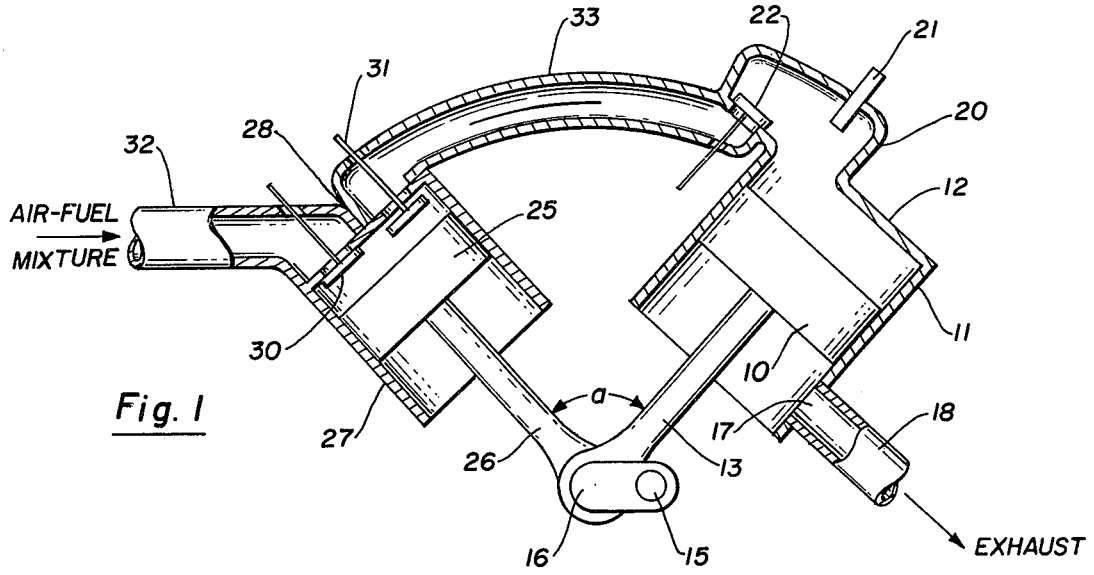
FIG. 1 is a schematic, partly in cross-section, view of a two-stroke engine embodying this invention.

The two-stroke engine illustrated in FIG. 1 includes an engine piston 10 operating within an engine cylinder 11 that is enclosed on the top with a cylinder head 12. An engine may, and usually will, include more than one cylinder. The piston 10 is connected through a connecting rod 13 to a crankshaft 15 which is constructed with its usual eccentric elements 16. The engine cylinder 11 has a port 17 in its side that is connected to an exhaust manifold 18 which will usually carry the exhaust through a muffler to be discharged to the atmosphere.

The engine illustrated in FIG. 1 also includes an intake chamber 20 that is provided with a spark plug 21 and an inlet valve 22. The intake chamber 20 is a cavity in the cylinder head 12.

The device of FIG. 1 also includes a pump piston 25 connected with connecting rod 26 to the same crank that holds connecting rod 17. Pump piston 25 operates in pump cylinder 27. Pump cylinder 27 has a head 28 that includes an inlet valve 30 and an outlet valve 31. Both inlet valve 30 and outlet valve 31 are biased to closed positions with springs and opened by the operation of cams and valve lifters not illustrated herein. Inlet valve 30 is surrounded with an inlet manifold 32 that carries a mixture of air and fuel provided, for example, by an ordinary carburator.

Outlet valve 31 discharges into intake manifold 33 which provides the air-fuel mixture to the engine cylinder 11.

The cyclic operation of the device illustrated in FIG. 1 can best be explained by starting at the beginning of the power stroke of engine piston 10. The power stroke is initiated, usually just before piston 10 reaches the top of its compression stroke by the firing of spark plug 21 which ignites the air-fuel mixture within chamber 20. At the point when the power stroke begins valve 22 is closed and the exhaust port is sealed from the interior of cylinder 11 by the piston 10. Upon ignition of the air-fuel mixture the piston 10 is pushed downwardly and provides the force to turn the crankshaft 15 thereby producing the work done by the engine. When piston 10 reaches the bottom of its stroke, port 17 is uncovered and exhaust from within the cylinder 11 escapes to the atmosphere. At that point the pressure within cylinder 11 is approximately atmospheric pressure and cylinder 11 is filled with exhaust gas. Upon completing the power stroke piston 10 begins moving upwardly to begin the compression stroke. As the piston 10 moves upwardly the exhaust gas in cylinder 11 becomes compressed more and more.

At some point in the cycle the valve 22 opens and a mixture of air and fuel under high pressure passes into the chamber 20. At least half of the air-fuel mixture passes into chamber 20 after port 17 becomes closed. The flow of the air-fuel mixture is resisted by the high pressure exhaust gas within cylinder 11 and accordingly exhaust gas is flushed out the chamber 20 and passes into cylinder 11 with minimum mixing of exhaust and air-fuel mixture. At the top of the compression stroke, the atmosphere surrounding spark plug 21 is entirely air-fuel mixture with no exhaust, and the interface between the air-fuel mixture and the exhaust gas under normal conditions is just slightly beyond the opening of the chamber 20 into cylinder 11. The position of the interface between the air-fuel mixture and the exhaust will differ depending upon how much the throttle is opened. Upon detonation of the air-fuel mixture a surge of energy moves toward the face of engine piston 10. This surge of energy is absorbed by the compressible-piston effect of the retained exhaust gas whereby the desirable gradual pushing against the piston 10 is obtained rather than the sharp impact of an explosion which does not transmit the force created by burning fuel to the crankshaft 15 as adequately. The valves are arranged so that at least half of the air-fuel mixture is introduced into the cylinder 11 during the compression stroke, specifically after exhaust port 17 is closed.

Rotation of the crankshaft 15 causes the connecting rod 26 to reciprocate. Starting at the top of the stroke of piston 25, when piston 25 moves downwardly inlet valve 30 opens, either by being drawn open by the suction effect of piston 25 or by a cam arrangement that causes it to open at the appropriate time in the cycle. Both methods for opening valve 30 are known to the art and need not be described in detail herein. When valve 30 is open and piston 25 is descending, the air-fuel mixture in inlet manifold 32 is drawn into the cylinder 27. At the bottom of the stroke piston 25 begins moving upwardly towards cylinder head 28, inlet valve 30 closes, and outlet valve 31 is opened by appropriate means. With outlet valve 31 open the air-fuel mixture in cylinder 27 is forced into manifold 33 where it accumulates at high enough pressure to enter the cylinder 11 when valve 22 opens. To insure that the pressure relationships in manifold 33 and in the chamber 20 in cylinder head 12 are appropriate to one another, the angle a between connecting rod 13 and connecting rod 26 may be set so that the stroke of piston 25 leads the stroke of piston 10 by an appropriate amount. In the embodiment of this invention illustrated, the angle that the pump piston leads the engine piston is about 85 degrees. It is also preferred that the flat surface of piston 25, the working surface, be smaller in area than the working surface of piston 10, and in a particularly preferred embodiment that it be about half of the surface area of piston 10. With appropriate adjustments of other elements of the device illustrated in FIG. 1 the pump piston may lead the engine piston by as much as 90 degrees or it may lag the piston engine by as much as 20 degrees. The appropriate adjustments include having the compression ratio of the pump appropriately higher than the compression ratio of the engine and even include injection of air fuel mixture during the power stroke.

A two-stroke internal combustion engine made in accordance with FIG. 1 will always have an undiluted air-fuel mixture surrounding the spark plug 21 during operation and it will always have very little mixing of the air-fuel mixture with the residual exhaust in the cylinder 12. This absence of mixing is a result of two factors. The first factor is the shape of the inlet to the cylinder 11, which shape prevents a large, turbulent interface between the residual exhaust gas in the cylinder 11 and the incoming combustible mixture, even at very low flow rates of air-fuel mixture, and because at least half of the injection of air-fuel mixture into chamber 20 is late in the compression stroke, the time during which mixing can occur is so restricted that the air-fuel mixture and residual exhaust gas have very little time for diffusion between them to occur.

A two-stroke internal combustion engine made in accordance with FIG. 1 will fire on substantially every stroke regardless of how much it is throttled because the shape of the chamber 20 and the late introduction of fuel will always cause spark plug 21 to be surrounded with a combustible mixture. This arrangement uses the energy of the fuel from the air-fuel mixture efficiently on every power stroke of the engine regardless of whether it is running with a fully open throttle or a greatly restricted throttle opening.

Figure 2:
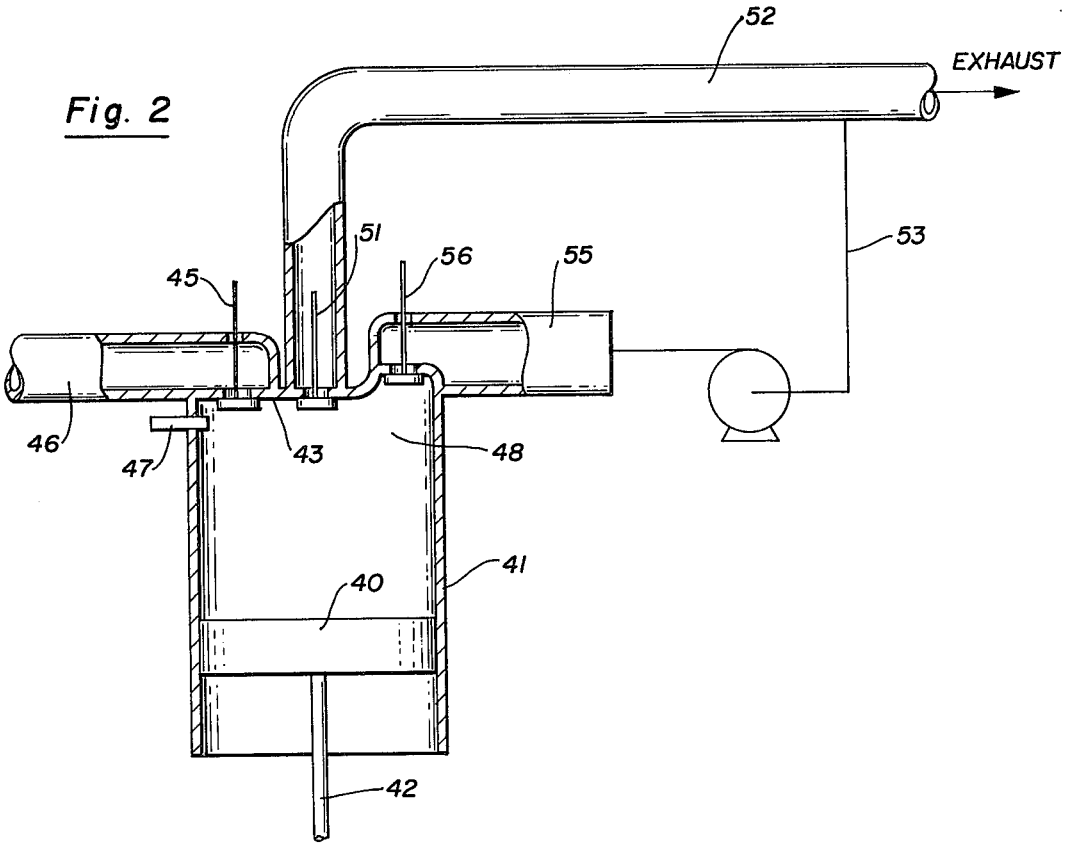
FIG. 2 is a schematic, partly in cross-section, view of a four-stroke engine embodying this invention.

FIG. 2 illustrates an embodiment of the invention as applied to a four-stroke engine. The embodiment illustrated in FIG. 2 shows one cylinder of a four-stroke engine as it would be at the beginning of the compression stroke. The elements of the engine include a piston 40 operating within a cylinder 41. The piston has a connecting rod 42 connecting it to a crank shaft in the usual fashion and the cylinder has a cylinder head 43 that is modified to adapt the device to this invention. The cylinder head 43 includes an inlet valve 45 that is arranged with cams and lifters, or other suitable devices, to open at the beginning of the intake stroke and to close at the end of the intake stroke. The air-fuel mixture is supplied through an inlet manifold 46.

After air and fuel are drawn into cylinder 41 and inlet valve 45 is closed, the next stroke of the piston 40, known as the compression stroke, compresses the mixture of air and fuel, and spark plug 47 is timed to fire just before piston 40 reaches the top of the compression stroke. Cylinder head 43 is arranged in this embodiment to have a chamber 48 of restricted volume which opens gradually into the main body of the cylinder 41. The upper portion of chamber 48 has a valve 56 to be described below.

Exhaust valve 51 is arranged with suitable cams and valve lifters to be opened when piston 40 reaches approximately the bottom of the power stroke and when piston 40 moves upward through its exhaust stroke, the exhaust gas within cylinder 41 is forced through valve 51. The exhaust goes through manifold 52 and ultimately is discharged to the atmosphere, usually through a muffler.

A portion of the exhaust in manifold 52 is removed through line 53 and compressor 54 and discharged into manifold 55 at a constant pressure that is suitable for the purposes explained hereinafter. Valve 56 controls the discharge from manifold 55 into cylinder 41.

The operation of the device illustrated in FIG. 2 will be explained starting with the beginning of the intake stroke of the piston 40. The intake stroke begins with piston 40 at the top of its reciprocation within cylinder 41 with the exhaust valve 51 having just closed and the inlet valve 45 having just opened. Throughout the downward stroke of piston 40 the air-fuel mixture is drawn into cylinder 41 through valve 45. At the bottom of the intake stroke valve 45 closes and piston 40 reverses direction and begins moving upwardly toward the cylinder head 43 and as it does so it begins compressing the air-fuel mixture within the cylinder 41. As the piston 40 moves upwardly the pressure within cylinder 41 becomes higher and higher. If the throttle was greatly restricted during the intake stroke, the amount of air-fuel mixture in cylinder 41 will be less and a given movement of piston 40 toward cylinder head 43 will produce a lesser pressure than if the throttle had been fully opened. When the piston 40 reaches some position in its upward travel, in the particular embodiment illustrated, valve 56 opens and the constant-pressure exhaust gas in manifold 55 flows into cylinder 41. The exhaust gas flows into cylinder 41 through shaped chamber 48 which maintains it as a compact mass, and it flows against a relatively high pressure of air-fuel mixture which tends to keep the exhaust gas entering valve 56 as a compact mass. Additionally, the late entry of exhaust through valve 56 gives little time for turbulence or diffusion to cause general mixing of the exhaust with the air-fuel mixture, and shortly after the introduction of the exhaust, spark plug 47 ignites the air-fuel mixture to begin the power stroke. Because of its location and because exhaust is introduced through chamber 48, spark plug 47 is completely surrounded with combustible air-fuel mixture so combustion will occur on every power stroke. In addition, the late entry of exhaust into cylinder 41 and its entry into cylinder 41 against a preexisting superatmospheric pressure causes a sharp interface between exhaust gas and air-fuel mixture so that substantially all of the air-fuel mixture is in the form of a combustible mixture and very little is unburned due to being mixed with exhaust.

Since the exhaust in manifold 55 is maintained at substantially a constant pressure, the amount of exhaust entering cylinder 41 when valve 56 opens varies depending upon the pressure of the combustible mixture within the cylinder 41. If the throttle is restricted, the pressure of combustible mixture in cylinder 41 will be lower and more exhaust gas will enter through port 50 while the opposite is true if the throttle controlling the flow of air-fuel mixture is not restricted. The overall effect of the structure shown in FIG. 2 is that the pressure within cylinder 41 at the end of the compression stroke is substantially the same whether the throttle controlling the air-fuel mixture is wide open or restricted because the constant pressure supply of exhaust gas toward the end of the compression stroke will automatically vary in amount to provide more exhaust gas when the air-fuel mixture is more throttled and less exhaust gas when the air-fuel mixture is less throttled.

As a result, the engine always operates with substantially the same pressure in the cylinder at the end of the compression stroke and with the air-fuel mixture as a discrete body of gas that is substantially unmixed with the exhaust whereby the engine always operates at conditions best designed for efficient operation. In addition, the presence of a discrete body of exhaust gas within cylinder 41 has the effect of a compressible piston and facilitates a smooth-flowing surge of force from the burning air-fuel mixture to the working face of the piston 40.

What is claimed is:

1. An internal combustion engine having a piston connected to reciprocate in a cylinder and to operate a work device, with the cylinder having an inlet for a combustible mixture of air and fuel and an outlet for exhaust, comprising said inlet adapted to maintain said combustible mixture as a substantially undiluted body of gas, means to fill the cylinder with one of said combustible mixture and said exhaust gas before the compression stroke of said piston begins, and a pump for supplying the other of said combustible mixture and said exhaust gas to the interior of the cylinder and adapted to supply half of said other gas after the outlet for exhaust is closed.

2. The engine of claim 1 wherein said engine is a two-stroke engine having means to fill the cylinder with exhaust gas before the compression stroke begins and wherein the combustible mixture is said other gas.

3. The engine of claim 2 wherein said pump is a piston pump having a piston connected to the crank driven by the engine piston at an angle between 90 degrees of lead to 20 degrees of lag of said pump piston with respect to said engine piston.

4. The engine of claim 3 wherein the working surface of the pump piston is smaller than the working surface of the engine piston.

5. The engine of claim 4 wherein the working surface of the pump piston is about one half the working area of the engine piston.

6. The engine of claim 1 wherein said engine is a four-stroke engine having means to fill the cylinder with combustible mixture before the compression stroke begins and wherein said other gas is exhaust.

7. The engine of claim 6 wherein said pump supplies exhaust gas at substantially constant pressure to a valve opening into said cylinder.

* * * * *